US010670259B2

(12) United States Patent
Krijn et al.

(10) Patent No.: US 10,670,259 B2
(45) Date of Patent: Jun. 2, 2020

(54) BASEBOARD LUMINAIRE FOR AMBIENT LIGHTING

(71) Applicant: SIGNIFY HOLDING B.V., Eindhoven (NL)

(72) Inventors: Marcellinus Petrus Carolus Michael Krijn, Eindhoven (NL); Hendrikus Hubertus Petrus Gommans, Eindhoven (NL); Jochen Renaat Van Gheluwe, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 68 days.

(21) Appl. No.: 15/503,345

(22) PCT Filed: Aug. 12, 2015

(86) PCT No.: PCT/EP2015/068526
§ 371 (c)(1),
(2) Date: May 27, 2017

(87) PCT Pub. No.: WO2016/023939
PCT Pub. Date: Feb. 18, 2016

(65) Prior Publication Data

US 2017/0234523 A1 Aug. 17, 2017

(30) Foreign Application Priority Data

Aug. 14, 2014 (EP) ..... 14180952

(51) Int. Cl.

| | |
|---|---|
| ***F21V 33/00*** | (2006.01) |
| ***F21S 8/00*** | (2006.01) |
| ***F21S 4/28*** | (2016.01) |
| ***E04F 19/04*** | (2006.01) |

(Continued)

(52) U.S. Cl.
CPC ..... *F21V 33/006* (2013.01); *E04F 19/0436* (2013.01); *F21S 4/28* (2016.01);
(Continued)

(58) Field of Classification Search
CPC . F21V 33/006; F21S 4/28; F21S 8/033; E04F 19/0463
See application file for complete search history.

(56) References Cited

U.S. PATENT DOCUMENTS

| | | | |
|---|---|---|---|
| 4,748,543 | A | 5/1988 | Swarens |
| 5,142,459 | A | 8/1992 | Swarens et al. |

(Continued)

FOREIGN PATENT DOCUMENTS

| | | | |
|---|---|---|---|
| CN | 102966883 | A | 3/2013 |
| EP | 2159347 | A1 | 3/2010 |

(Continued)

*Primary Examiner* — Karabi Guharay
(74) *Attorney, Agent, or Firm* — Daniel J. Piotrowski

(57) ABSTRACT

The invention provides an elongated lighting element (200) for attachment to a building part (10) selected from the group consisting of a wall (11), a ceiling (12) and a floor (13), wherein the building part (10) comprises a first attachment unit (131) and a first electrical power connector (141), wherein the elongated lighting element has a front side (210) and at the other side of the front side (210) (i) a second attachment unit (231) for forming with the first attachment unit (131) said attachment to said building part (10), (ii) a second electrical power connector (241) for forming an electrical connection with the first electrical power connector (141), and (iii) a plurality of solid state based light sources (250) configured to provide light source light (251) and functionally connected with the second electrical power connector (241).

19 Claims, 7 Drawing Sheets

(51) Int. Cl.

| | |
|---|---|
| ***F21V 21/02*** | (2006.01) |
| ***G08B 7/06*** | (2006.01) |
| *F21Y 103/10* | (2016.01) |
| *F21Y 115/10* | (2016.01) |
| *F21V 21/088* | (2006.01) |
| *F21W 111/027* | (2006.01) |

(52) U.S. Cl.
CPC ..... *F21S 8/033* (2013.01); *F21V 21/02* (2013.01); *G08B 7/066* (2013.01); *E04F 2019/0454* (2013.01); *F21V 21/088* (2013.01); *F21W 2111/027* (2013.01); *F21Y 2103/10* (2016.08); *F21Y 2115/10* (2016.08)

(56) References Cited

U.S. PATENT DOCUMENTS

| | | | | |
|---|---|---|---|---|
| 5,782,551 | A * | 7/1998 | Capaul | B32B 15/14 362/148 |
| 6,994,456 | B1 | 2/2006 | Russo et al. | |
| 8,128,253 | B2 * | 3/2012 | Opitz | G02B 6/0011 362/145 |
| 2004/0105264 | A1 | 6/2004 | Spero | |
| 2013/0083524 | A1 | 4/2013 | Devorris | |
| 2013/0120974 | A1 | 5/2013 | Swisha et al. | |
| 2014/0024249 | A1 | 1/2014 | Adams et al. | |

FOREIGN PATENT DOCUMENTS

| | | | |
|---|---|---|---|
| JP | 04174166 | A | 6/1992 |
| JP | 2001003553 | A | 1/2001 |
| JP | 2001338526 | A | 12/2001 |
| JP | 2005282257 | A | 10/2005 |
| JP | 2008078015 | A | 4/2008 |
| JP | 2009187763 | A | 8/2009 |
| JP | 2010080139 | A | 4/2010 |
| JP | 2011113115 | A | 6/2011 |
| JP | 3180564 | U | 12/2012 |
| JP | 2013084469 | A | 5/2013 |

* cited by examiner

BASEBOARD LUMINAIRE FOR AMBIENT LIGHTING

CROSS-REFERENCE TO PRIOR APPLICATIONS

This application is the U.S. National Phase application under 35 U.S.C. § 371 of International Application No. PCT/EP2015/068526, filed on Aug. 12, 2015 which claims the benefit of European Patent Application No. 14180952.5, filed on Aug. 14, 2014. These applications are hereby incorporated by reference herein.

FIELD OF THE INVENTION

The invention relates to a lighting element, especially for e.g. wall washing applications. The invention also relates to a lighting system comprising such lighting element, as well as to a method for providing such lighting element or lighting system to a building part.

BACKGROUND OF THE INVENTION

The use of wall washing lighting is known in the art. U.S. Pat. No. 4,748,543, for instance, describes a fluorescent indirect lighting fixture having its light source concealed from normal view by locating the lamps in a partially wrapped-around region to one side of an offset reflector, which is shaped in a special concave curvature to produce uniform "wall wash" illumination. A producible high quality reflective surface with required curvature maintained by a rigid accurate reflector assembly is achieved by utilizing a thin flexible reflective lining of high purity aluminum conformally laminated against a rigid extruded aluminum reflector body of required curvature. Two-piece end plates provide lamp socket mountings, integral wiring conduits, reflective inner end surfaces, decorative trim at light-exit window ends and reflector body reinforcement. The complete reflector module including ballasts and AC power plug is easily installed, without tools, into a recessed builder's housing, firmly held with no exposed screw heads or other fastenings yet readily removable for service due to a novel torsion spring retaining system. With the fixture in place, only the reflector surfaces and coordinated reflective trim, framing the light-exit window, are presented to normal view. Direct light, extraneous light and lamp images are virtually eliminated.

US20040105264A1 discloses an elongated lighting element for attachment to a building part, wherein the building part comprises an attachment unit and an electrical power connector for mechanical connection respectively functional, electrical connection with the lighting element, the lighting element comprising a plurality of solid state light sources.

SUMMARY OF THE INVENTION

From interior lighting design it is concluded that there is a wish to create an impressive lighting effect with minimally visible elements, preferable unobtrusively installed. A drawback of illuminating large areas of the ceiling or wall is that one has to create sufficient distance between the light source and the illuminated surface.

Hence, it is an aspect of the invention to provide an alternative lighting unit or lighting element, which preferably further at least partly obviates one or more of above-described drawbacks. It is further an aspect of the invention to provide a lighting unit or lighting element that can easily be installed. It is yet a further aspect of the invention to provide an alternative method for installation of such lighting unit or lighting element.

One of the few elements that are present in nearly all living rooms and offices are baseboards (and/or ceiling boards), used to mask the transition from floor to wall (and/or wall-ceiling) and often used to hide, for example, cables for audio-video equipment. As is typical for baseboards, they can be mounted unobtrusively on a wall in contact with a floor. Substantially the same may (thus) apply to ceiling moldings or ceiling boards.

Herein we propose—amongst others—to equip such baseboards, or other types of elements for use in (or on) a building, with an ambient lighting functionality. The lighting functionality may especially be selected from the group of floor washing, wall washing and ceiling washing, especially wall washing and/or ceiling washing, and may optionally include dynamic light effects. Since—amongst others—baseboards can be relatively easily installed, the solution proposed herein offers a low threshold for people to acquire what in effect will be an embedded lighting solution (i.e. without the need for invasive construction work). Hence, herein we describe amongst others a method for ceiling illumination where the light source is unobtrusively mounted onto the wall behind e.g. a baseboard or other element. Using collimating elements, the light source can be installed close to the ceiling such that nothing can restrict the illumination angle and, in addition, one cannot look into the sources (thereby preventing glare).

Hence, in a first aspect the invention provides an (elongated) lighting element for attachment to a building part, such as especially selected from the group consisting of a wall, a ceiling and a floor, especially selected from the group consisting of a wall, a ceiling and a floor, wherein the building part comprises a first attachment unit and a first electrical power connector, wherein the (elongated) lighting element has a(n elongated) front side and at the other side of the front side (i) a second attachment unit for forming with the first attachment unit said attachment to said building part, (ii) a second electrical power connector for forming an electrical connection with the first electrical power connector, and (iii) one or more light sources, especially a plurality of light sources, especially (a plurality of) solid state based light sources, configured to provide light source light and functionally connected with the second electrical power connector wherein the element comprises a virtual element plane, which, when the element is attached to the building part, will be configured parallel to the building part, wherein the plurality of solid state based light sources further comprise additional optics, rendering the lighting element to be configured to provide at least 50% of said light source light within a space defined by said virtual element plane and a second virtual plane perpendicular to said virtual element plane.

With such lighting element, it is possible to illuminate e.g. a large part of the ceiling (or wall, etc.), for instance not limited to the surface area directly above the element. Especially, such lighting element can be configured as baseboard. However, other configurations are also possible (see below). Hence, without e.g. glare, and without substantial obtrusion, e.g. a room may be illuminated, e.g. by wall washing, floor washing and/or ceiling washing. Herein we choose for instance a baseboard as the mounting and housing element as it is the most common element used in house improvement to mount onto the wall. For baseboards, but also for ceiling boards, a large variety in designs and mounting mechanisms are known and commercially available. The baseboard or ceiling board may especially comprise the lighting element, and optionally also the building element. The latter may be associated to the building part first, where after the lighting element can be associated to the building element. The lighting element and building element are especially configured to be associated to each other in a male-female configuration.

The lighting element is configured to provide at least 50% of said light source light within a space defined by said virtual element plane and a second virtual plane perpendicular to said virtual element plane. For collimation to obtain this specific directionality of issued light, additional optics are provided to the lighting element, especially optics may be used like reflectors, collimators, etc. Typically the light sources in the lighting element are LEDs. The additional optics are in addition to the optics formed by the LED die dome, or if the LED die is without dome, the additional optics are a part separate from the LED die, i.e. unlike the LED dome the additional optics are not formed as an integral part with the LED die. In a specific embodiment, the lighting element comprises an extruded housing, with a part of the additional optics formed during the extrusion process. E.g. a V-shaped collimator may be extruded in the housing.

The lighting element is especially an elongated lighting element by which a length direction is defined. Likewise, the building element (see also below) is especially an elongated building element. Also the front side is especially elongated. The terms "elongated lighting element", "elongated front side", and similar terms especially indicate that the length is larger than the width and/or height. The length of the elements and the front side may (independently) be at least 5, or at least 10 times, or even at least 20 times more than the height or the width of the element. For instance, the length of the lighting element, and optionally also of the building element, may be substantially equal to the length of commercially available office wall elements. Especially, the thickness and height of the lighting element are at least 5 times, even more especially at least 10 times, yet even more especially at least 20 times smaller than the length. For instance, the length of the element(s) (and the front side) may be in the range of 0.5-5 meters, such as 1-3 meters.

As indicated above, the lighting element comprises a second attachment unit for forming with the first attachment unit said attachment to said building part. This attachment is further also described below. Further, the lighting element comprises a second electrical power connector for forming an electrical connection with the first electrical power connector. This may especially be a plug-socket connection. However, in other embodiments the first electrical connector that is provided to the second electrical connector of the lighting element may be an elongated electrical connector. This may provide more freedom in arranging the lighting element. Further, the term "electrical connector" may also refer to plurality of electrical connectors. Also in this way, freedom in arranging the lighting element may be provided. Note that in general the electrical connectors at least include two electrical connections (such as "neutral" and "line"), as known in the art. In general, the electrical infrastructure to the lighting element will include a transformer, to provide to the lighting element e.g. 12 V or 24 V DC, especially at least below 50 V, as is known in the art. For instance, the building element (see also below) may comprise a transformer, or upstream from the building element a transformer is arranged, to convert 110 V or 220 V, or other common AC voltages, to a much lower DC voltages, as is known for especially solid state light sources. The transformer may optionally be integrated in the building element(s).

The light sources and the electrical connections, and optionally other (electrical) elements like optics, a control unit, etc., are hidden behind the front side. Hence, the lighting element may include a back side and a front side, with the back side being configured to the building part (during use of the lighting element), and the front side being visible to a user (during use of the lighting element). In some embodiments, the front side may be a conventional front side of a base molding (sometimes also indicated as "floor molding") or ceiling molding, or other type of ornamental strip.

Further, as indicated above, the lighting element especially includes a plurality of light sources, especially solid state based light sources, configured to provide light source light and functionally connected with the second electrical power connector. The light source light may be colored light or white light. Further, a combination of different types of light sources may be applied, configured to generate different types of light. Optionally the color of the light is tunable (by a control unit, see below). Further, optionally the color and/or intensity of the light source light are independently controllable over the length of the lighting element. A single lighting element may include a plurality of light source e.g. having a pitch in the range of 0.5 to 15 cm, such as in the range of 1-5 cm. This may provide an even illumination of a surface of a building part.

The light source(s) especially comprises a solid state based light source. The term "light source" may also relate to a plurality of light sources, such as 2-20 (solid state) LED light sources. Hence, the term LED may also refer to a plurality of LEDs. The term "solid state based light source indicates" that the light source at least includes a solid state light source. In a specific embodiment, the light source(s) comprises a solid state LED light source (such as a LED or laser diode). However, the light source(s) may further include one or more other elements like a reflector, a transmissive window, a collimator, a wavelength converter for changing the spectral distribution of the light, etc.

Hence, in an embodiment the lighting element may further comprise a lighting element control unit configured to control the solid state based light sources in dependence of a signal, especially an external signal, such as from another control unit (see below) or from a sensor, etc. Further, the lighting element control unit may be configured to control one or more of light intensity, color of the light, color temperature of the light, etc., for one or more light sources independently of one or more other light sources. Hence, for instance, the light source light may also be dynamic. In a specific embodiment, the lighting element comprises a plurality of subsets of (solid state based) light sources, wherein the lighting element control unit is configured to control the plurality of subsets of (solid state based) light sources independently. Again, the term "control" and similar terms may refer to the control of the light intensity, the light color, and the color temperature, etc.

In a specific embodiment, the lighting element control unit is configured to provide information about the solid state based light sources to an external control unit. This may be useful when the external control unit is not aware (in advance) of the light sources available. By providing this information, the external control unit can control one or more lighting elements, especially the light sources thereof.

Such lighting element may easily be arranged to a building part, such as a wall, a ceiling, or optionally even a floor. Especially, this may be done with two elements, which may optionally be configured as male and female elements, with one of the elements including the lighting element and the other element being a building element. The term "building element" is used to indicate that this element is in general connected to the building part, such as a wall. The lighting element can on its turn be connected to the building part. The lighting element may e.g. be attached to the building element e.g. by Snap-On snap-of means, or a Velcro connection, etc. Especially, a male-female attachment may be applied. The attachment or connection may be a one-way attachment i.e. that after attaching the elements may not be removed from each other without breaking a part. However, the attachment may also be a detachable attachment.

In a specific embodiment, the lighting element is an element selected from the group consisting of a baseboard, a floor molding and a ceiling molding (or ceiling board). Hence, the lighting element may especially be arranged at the angle between a floor and a wall, or at the angle between a wall and a ceiling. However, the principle of the invention may be applied broader. Hence, in principle any strip-like lighting element may be used. For instance, rails that are used for suspending posters or paintings may alternatively be used, having the functionality of a lighting unit and a means for suspending one or more items, such along e.g. a wall. The lighting element may also be arranged anywhere on a wall or ceiling, or optional floor, and even also other objects, indoor or outdoor, especially indoor. For instance, the invention may also be applied in tunnels, under viaducts, along curbs, etc. Especially, however the lighting element, the kit of parts, the lighting system, etc., may be applied indoor, such as in a house, an office, or any (other) space. The space may for instance be (part of) a hospitality area, such as a restaurant, a hotel, a clinic, or a hospital, etc. The term "space" may also relate to (a part of) an office, a department store, a warehouse, a cinema, a church, a theatre, a library, etc. However, the term "space" also relate to (a part of) a working space in a vehicle, such as a cabin of a truck, a cabin of an air plane, a cabin of a vessel (ship), a cabin of a car, a cabin of a crane, a cabin of an engineering vehicle like a tractor, etc. The term "space" may also relate to (a part of) a working space, such as an office, a (production) plant, a power plant (like a nuclear power plant, a gas power plant, a coal power plant, etc.), etc. For instance, the term "space" may also relate to a control room, a security room, etc.

The lighting element, and especially the light source, including optional optics, may especially be configured to provide a beam having a full width half maximum (FWHM) equal to or smaller than 120°, even more especially equal to or smaller than 90°. Dependent upon the application and/or intended arrangement, this may even be smaller, such as a FWHM equal to or smaller than 60°. For many wall washing applications, this width may be enough, or can even be smaller, to provide the intended wall washing, as the light source may illuminate the wall or other building part with light source light substantially parallel to such building part. With the invention, an improved illumination for ambient lighting at the ceiling may e.g. be obtained.

In yet a further embodiment, the front side may comprise a transmissive window, and one or more solid state based light sources are configured to provide said light source light downstream from said transmissive window (hence, the transmissive window is at least transmissive for part of the light source light). This does not exclude the use of transmissive windows elsewhere in the lighting element. The term "transmissive" may refer to translucent or transparent. Especially the transmissive window may be translucent, to hide the light source(s) to some extend or entirely to a user when the light source(s) is (are) in the off-state. In yet another embodiment, the transmissive window is substantially transparent, which may lead to a better defined light source light beam.

In a specific embodiment, the lighting element comprises a (hollow) body, with the (elongated) front side, and the light source(s) and optionally other elements integrated in the (hollow) body.

In a further aspect, the invention also provides a kit of parts comprising (i) the elongated lighting element as described herein, and (ii) a building element, wherein the building element comprises a first attachment unit and a first electrical power connector for a functional attachment and electrical connection of the building element and the elongated lighting element. The term "kit of parts" refers to the combination of the two elements. This may be a combination in a package, such as for sale. However, this may also be the combination during use, i.e. the application. Further, the kit of parts may include a plurality of building elements. Alternatively or additionally, the kits of parts may include a plurality of lighting elements.

As indicated above, the kit of parts may in an embodiment refer to a packaged combination of one or more building elements and one or more lighting elements. However, the term kit of part may in an embodiment also refer to the combination per se of one or more building elements and one or more lighting elements. In a specific embodiment, the term "kit of parts" may also refer to an assembly (i.e. a functional system) of one or more building elements and one or more lighting elements, which is herein also indicated as "lighting system" (see also below).

The lighting element is especially designed to cover substantially the building element, at least the height or width of the lighting element is such that it can cover the height or width of the building element (in use position). In this way, a user may only perceive the front side, and not the building element behind the front side.

In a specific embodiment, the building element comprises a building element control unit, and the lighting element further comprises said lighting element control unit (see also above) configured to control the solid state based light sources in dependence of signal from the building element control unit. Hence, the building control unit can instruct the lighting element control unit. Note that one building element control unit may communicate with one or more lighting element control units. Communication may be done wired or wireless (see also below). Optionally, the building element control unit and the lighting element control unit may be integrated in a single control unit. In such embodiment, such integrated control unit may especially be integrated in a building element, or optionally extern from the building element(s).

Further, the building element control units and/or the lighting element control units may be configured to communicate with a plurality of (other) control units. For instance, adjacent lighting element control units may communicate with each other and/or adjacent building element control units can communicate with each other. Optionally communication may also be cross-communication, i.e. the building element control unit communicating with a lighting element attached to an adjacent building element, etc. Hence, in a specific embodiment one or more of a lighting element control unit and the building element control unit are configured to communicate with one or more of a lighting element control unit and a building element control unit of another lighting element and building element, respectively. Such communication may be necessary to learn a central control system all available light sources. Such communication may also be necessary to control the light sources for creating a dynamic effect over a plurality of light sources, especially distributed over a plurality of lighting elements. Such communication may also be desired when using the light source light to guide people (see also below). As indicated above, the central control system may be a building control unit integrated in a (single) building element or may be configured external from the building element(s).

Hence, an important feature may be that in embodiments of the invention the elements may be connectable. In this way, adjacent lighting elements of meters, or dozens of meters, or even hundreds of meters, may be created. This may also be used to provide information, like guiding information. Hence, for instance in this way also a lighting system may be provided. Hence, especially the lighting elements and/or building elements may be functionally coupled to each other, allowing e.g. one or more of electrical powering of and/or communication with adjacent lighting elements and/or building elements.

Therefore, in a further aspect the invention also provides a lighting system comprising a one or more (elongated) lighting elements, especially a plurality of (elongated) lighting elements as described herein, and one or more (elongated) building elements as described herein, wherein the (elongated) lighting elements and the one or more (elongated) building elements are functionally coupled. One or more lighting elements may be attached to a single building element. Especially, a plurality of lighting elements may be attached to a plurality of building elements, wherein in general the number of lighting elements is equal to or larger than the number of building elements, especially equal to the number of building elements. With the invention over a large length, of e.g. a room, the lighting elements may be provided. Optionally, connectors may be used to connect adjacent building elements and/or adjacent lighting elements. Hence, the kit of parts (see also above) may also include one or more connectors configured to functionally couple adjacent building elements and/or adjacent lighting elements. The term "functionally coupling" may especially indicate that electrical connections are created between adjacent building elements and/or adjacent lighting elements. The term "electrical connections" may especially indicate the connections for providing electrical power and/or for (wired) communication.

The kit of parts may thus further include at least one control unit, configured to control the light sources of the lighting element. This may be a control unit integrated in a lighting element, which is especially indicated as lighting element control unit. Alternatively or additionally, this may be a control unit integrated in a building element, which is especially indicated as building element control unit. Especially, such latter control unit may control the former control unit. In a specific embodiment, the kit of parts includes a plurality of lighting elements, each including a lighting element control unit, and one or more building elements, wherein at least one, and optionally each, including a building element control unit. At least one of the building element control units may be configured as master control unit, configured to control all other control units. Further, the kit of parts may include a user interface, configured to instruct the one or more control units, especially at least one building element control unit, and in a specific embodiment such master control unit. The user interface may be integrated in a remote controller, configured to control the one or more control units, especially at least one building element control unit, and in a specific embodiment such master control unit.

In a specific embodiment of the lighting system, neighboring lighting elements are functionally connected to each other, and the lighting system may further comprise a communication line configured to provide instructions to each lighting element. The communication line is herein also indicated as "data line" or "serial data line". The serial data line may in an embodiment be established via an electrical connection of the building elements. Alternatively, the serial data line may in an embodiment be established via an electrical connection of the lighting elements. Likewise, in an embodiment the control units for controlling the lighting elements, such as for auto commissioning of the lighting elements, can be located in the building elements or in the lighting elements. As indicated above, optionally there may be one master control unit, controlling all building element control units.

Further, as indicated above, the invention also provides in yet another aspect a method to provide information to a user, the method comprising using the lighting system as defined herein, wherein the light source light is used to provide said information. In a specific embodiment, the lighting system may be used to guide a user in a specific direction. Hence, in an embodiment the lighting element control units and the building element control units are configured to execute such method.

In yet a further aspect, the invention also provides a method for providing (or installing) such lighting element, and especially a plurality of lighting elements, such as e.g. an entire lighting system. Therefore, the invention also provides a method for providing an (elongated) lighting element to a building part, the method comprising: (i) providing a first attachment unit and a first electrical power connector to the building part; and (ii) attaching the elongated lighting element as defined in herein, by attaching the first attachment unit and the second attachment unit to each other and functionally connecting the first electrical power connector and the second electrical power connector. Such method may also include functionally coupling adjacent building elements and/or lighting elements, such as e.g. with (electrical) connectors. The method may also include arranging one or more building elements to a building part, thereby providing one or more first attachment units and one or more first electrical power connectors (to the building part).

The terms "upstream" and "downstream" relate to an arrangement of items or features relative to the propagation of the light from a light generating means (here the especially the first light source), wherein relative to a first position within a beam of light from the light generating means, a second position in the beam of light closer to the light generating means is "upstream", and a third position within the beam of light further away from the light generating means is "downstream".

The lighting device may be part of or may be applied in e.g. office lighting systems, household application systems, shop lighting systems, home lighting systems, accent lighting systems, spot lighting systems, theater lighting systems, warning sign systems, medical lighting application systems, indicator sign systems, decorative lighting systems, etc.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

The drawings are not necessarily to scale.

DETAILED DESCRIPTION OF THE EMBODIMENTS

Figure 1A:
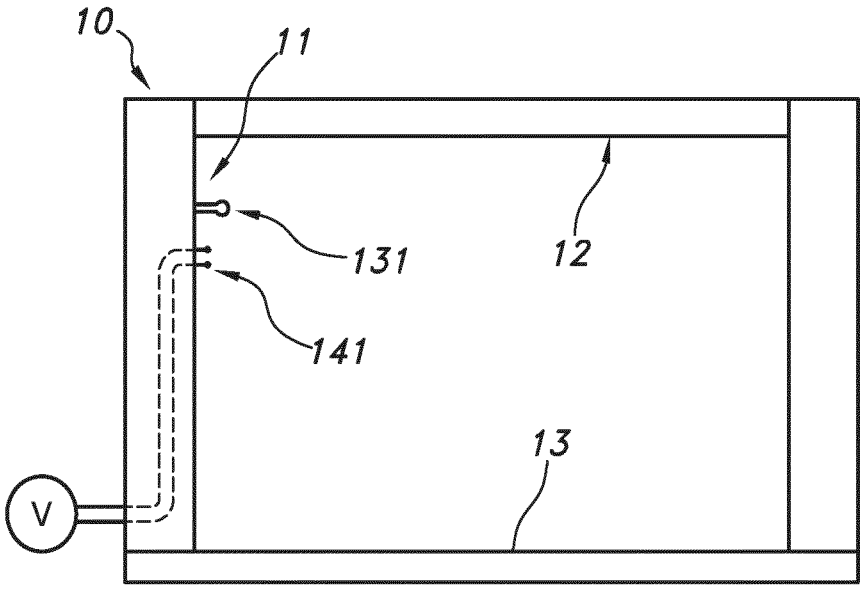
FIGS. 1*a*-1*g* schematically depict some basic aspects of the invention.

FIG. 1*a* schematically depicts (in side view) a building part 10, here a wall 11, comprising a first attachment unit 131 and a first electrical power connector 141. The power lines are drawn with dashes, to indicate that these lines may be within the building part. Reference 12 indicates a ceiling and reference 13 indicates a floor.

Figure 1B:
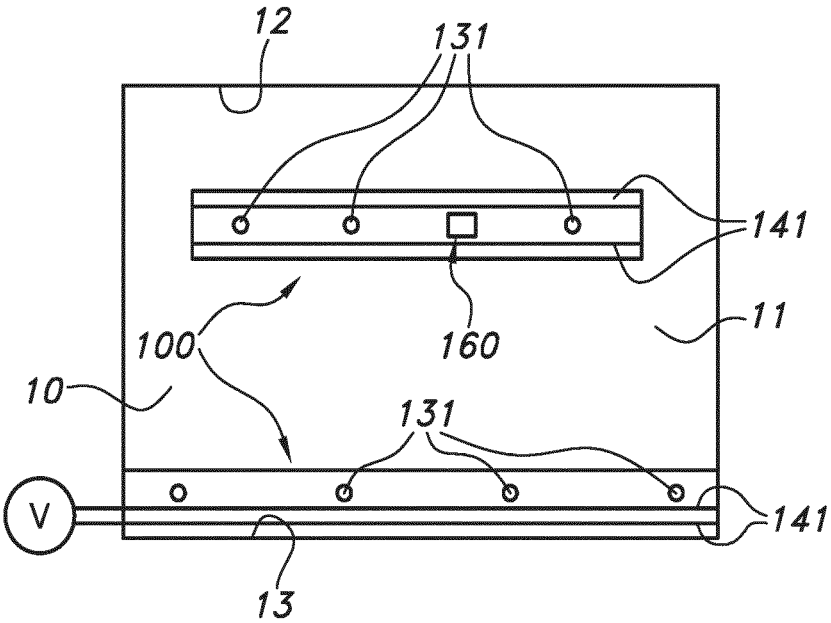

FIG. 1*b* schematically depicts such first attachment unit 131 and electrical power connector 141 integrated in a (elongated) building element 100. Such building element may be attached to a wall or ceiling, in principle anywhere. Here, two options are indicated, with the lower e.g. suitable to arrange a lighting element in the form of a flour molding, and with the higher one e.g. suitable to attach as strip like lighting element. Reference 160 indicates a building element control unit. Note that the electrical connectors are provided as line connectors, providing a lot of freedom where to arrange a lighting element. Of course, the electrical connection may be protected. However, for the sake of understanding they clearly are shown.

Figure 1C:
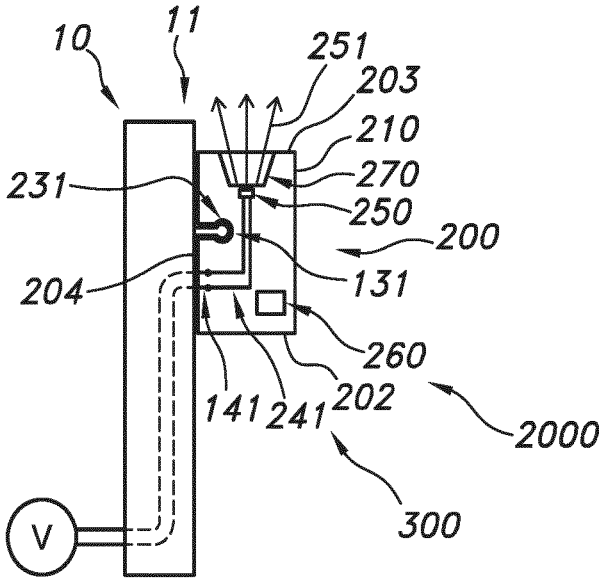

FIG. 1*c* schematically depicts in a side view an embodiment of an (elongated) lighting element 200 for attachment to a building part 10, here again wall 11. The lighting element 200 is show in the attached state. The elongated lighting element has a front side 210 and at the other side of the front side 210, a second attachment unit 231 for forming with the first attachment unit 131 said attachment to said building part 10 is provided. Further, a second electrical power connector 241 for forming an electrical connection with the first electrical power connector 141 is provided. In this way the building element 100 and the lighting element 200 may be functionally coupled. In side view, only a single (solid state based) light source 250 is depicted. The light source 250 is configured to provide light source light 251. Further, this light source 250 is functionally connected with the second electrical power connector 241. Thereby, electrical power can be received from an external power source. Reference 270 indicate additional optional optics, e.g. the shape the light source light (beam), in the figure a reflector body, but which alternatively could be, for example, a refractive lens or a TIR body.

References 202, 203, 204, and also 210 indicated edges. Note that the lighting element does not necessarily have a beam like shape (here in FIG. 1*c* a cross-section is shown). Reference 300 indicates the kit of parts, including in general at least one lighting element and at least one building element. Further, reference 2000 indicates a lighting system. Reference 260 indicates a lighting element control unit, for control of the light source(s) 250 (especially the light 251 thereof). The lighting element 200 as schematically depicted here may e.g. comprise a hollow body, with the indicated edges 202, 203, 204, 210 (and 205,206; see below).

Figure 1D:
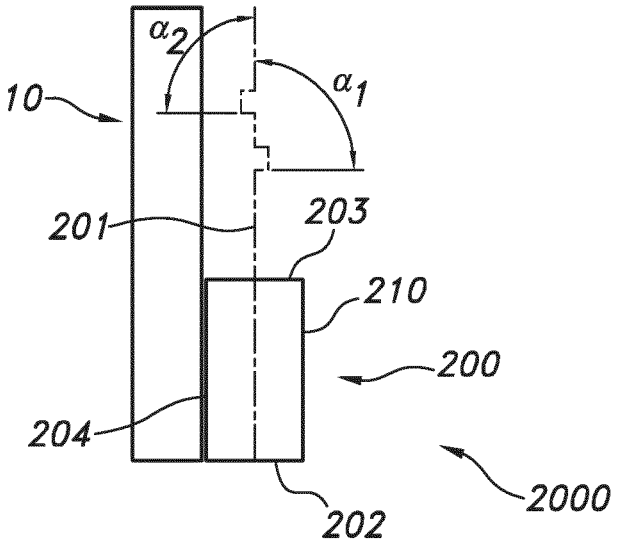

FIG. 1*d* schematically depicts an (application) embodiment, wherein the element comprises a virtual element plane 201, which, when the element is attached to the building part 10, will be configured parallel to the building part 10, wherein the lighting element 200 is configured to provide at least 50% of said light source light 251 within a space defined by said virtual element plane 201 and a second virtual plane (202) perpendicular to said virtual element plane 201. Here, by way of example two of such spaces are indicated with the respective angles $\alpha 1$ and $\alpha 2$. Note that as part of the light may thus also be outside this space. With this definition, it is indicated that especially at least part of the light, even more especially at least a substantial part of the light may be provided in grazing way ("washing" of the wall or ceiling (or floor)). The term wall washing is known in the art and especially refers to a lighting design technique for illumination of large surfaces. Herein, the terms ceiling washing and/or floor washing is only used to indicate different building parts that are illuminated. In principle this illumination may also be indicated as "wall washing".

Figure 1E:
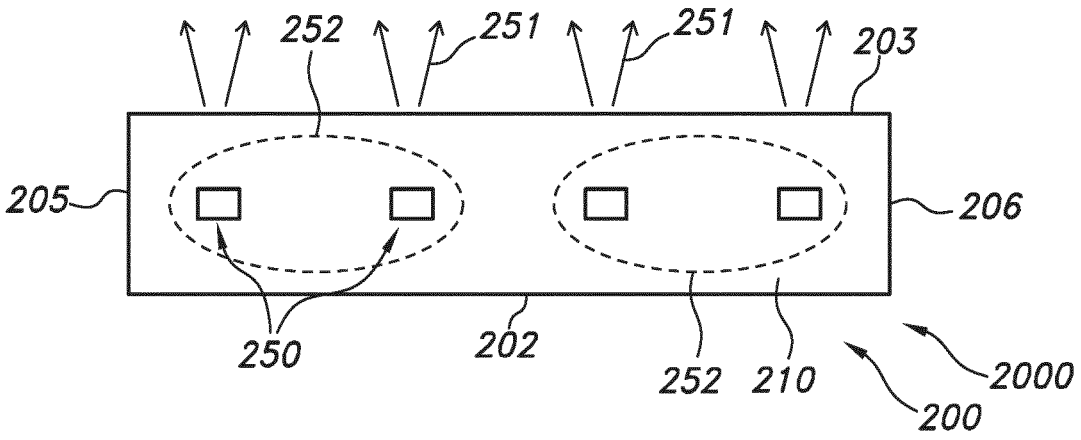

FIG. 1*e* schematically depicts a front view of a lighting element 200, with four light source at the back side, but for the sake of argument made visible as if the front side would be transparent. References 205 and 206 indicate edges. This may e.g. the front view of the embodiments schematically depicted in FIGS. 1*a*-1*d*. Further, these drawings 1*a*-1*e* show embodiments wherein the thickness and height of the lighting element are at least 5 times, smaller than the length. The length of the element(s) (and the front side) may be in the range of 0.5-5 meters, such as 1-3 meters. Reference 252 indicate subsets of the solid state light sources 250 which are independently controllable by a (external) lighting element control unit 260 (not shown in FIG. 1*e*).

Figure 1F:
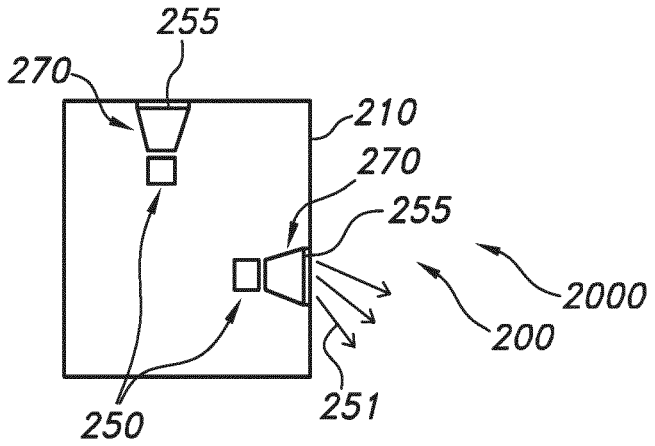

FIG. 1*f* schematically depicts an embodiment of the lighting element with a transmissive window 255 at the front side 210. This might e.g. be used for floor washing or ceiling washing, dependent upon where the lighting element will be configured. However, other applications may also be possible. By way of example, this lighting element 200 may be configured to provide light source light 251 in two different directions.

Figure 1G:
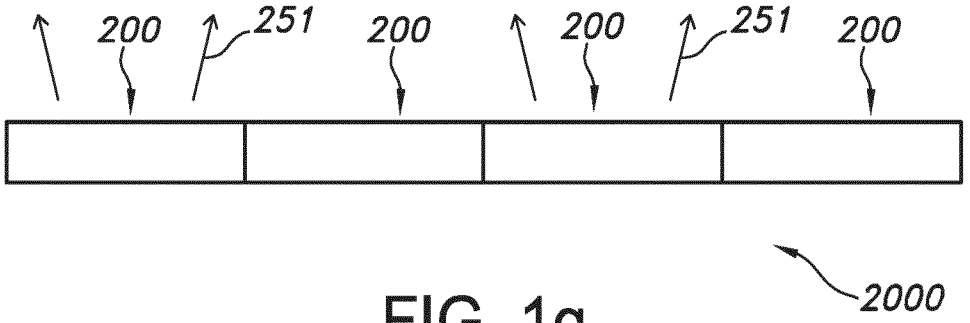

FIG. 1*g* very schematically depicts a lighting system 2000 comprising a plurality of lighting elements 200. These lighting elements may be functionally coupled and controlled by one or more control units (not indicated). The front sides are elongated panels, which may conceal the building part as well as the electronics and optics of the lighting element to a viewer.

Figure 2A:
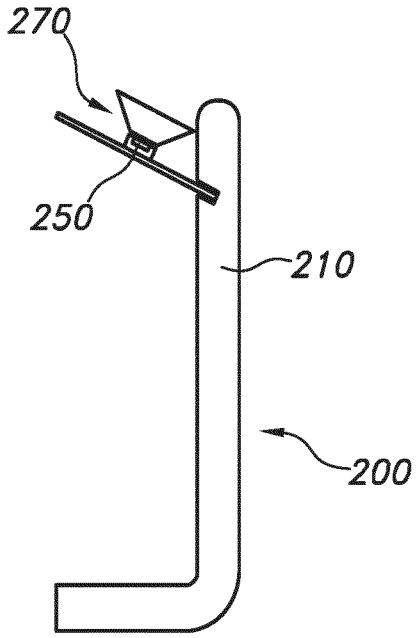
FIGS. 2*a*-2*f* schematically depict some aspects of the invention.

In an embodiment, a relevant feature is a tilted LED board plus collimating optics behind a baseboard. Components may especially include a LED module, an optical element and a baseboard. The LED module may contain a collection of LEDs in a row with a pitch in the range of 0.5 to 15 cm. For instance, modules with modular length of one foot (=30.5 cm) that can be connected in series can be chosen. Other well-known examples for linear spaced LEDs are LED lines on a roll. One should bear in mind that additional cooling elements may not be necessary, but may be included. The optical element could have extrusion symmetry and its degree of collimation should e.g. be in the range of e.g. 5 to 35° FWHM. The typical shape of a collimator may be a wedge. Its exit window may have a frosted or diffusing appearance as to facilitate intensity smoothing and/or color mixing. The baseboard itself can be customized. FIG. 2*a* schematically shows a LED module with an extruded collimator and baseboard. Not shown is a transparent cover on top of the optical element to prevent the baseboard from collecting dust and for facilitating cleaning. This cover may have an optical function.

Figure 2B:
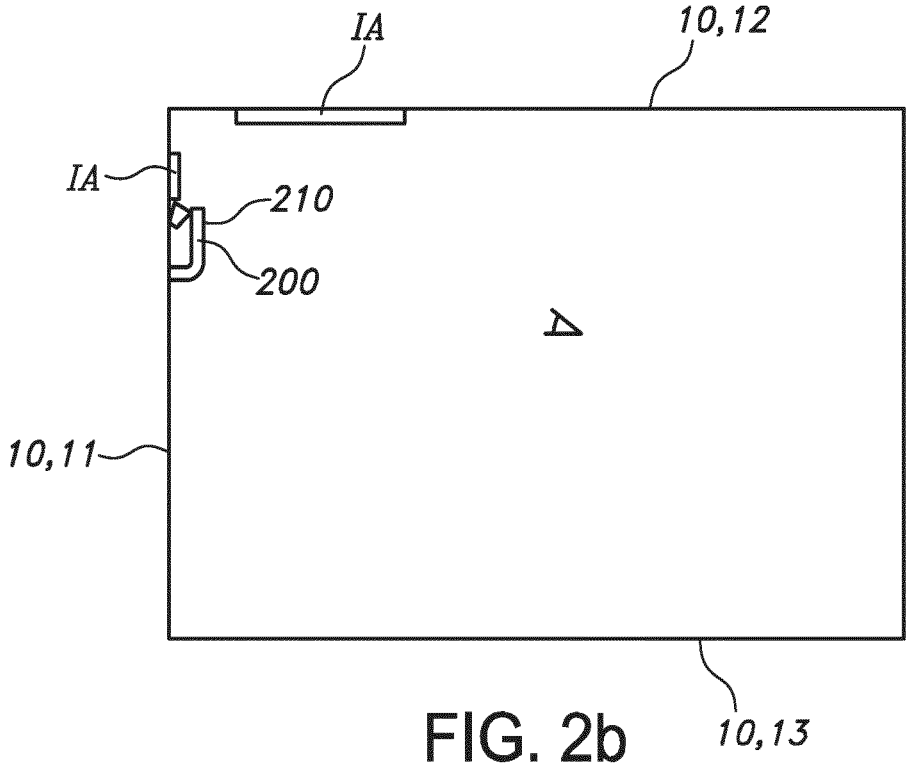

FIG. 2*b* schematically a linear spot using an optical element behind the baseboard, with here a geometric layout in a room. References IA indicate illuminated areas (by way of example).

A baseboard installed onto the wall on eye level is typically applied in (student) rooms, where the baseboard is used as mounting element for clothes hangers, posters, painting, mirror etc. In this way the wall and its plaster is protected from customization, while the baseboard itself can be easily replaced.

Lighting adapters and even the power socket(s) can be masked behind the baseboard (or other type of element), especially behind its frond side. Further, in an additional embodiment the baseboard can also provide power, such that power sockets are no longer mounted onto the wall.

The above (and below) embodiments may provide unobtrusive ambient lighting for e.g. homes, hotel rooms, meeting rooms, and student rooms, hospitality areas, etc. At present, there are no solutions yet that provide ambient lighting such as wall washing or floor washing across a room and in such a way that the means for creating such effect are unobtrusive, especially in the off-state. Herein, we present a method to create such ambient lighting effects by unobtrusive means, while still making it relatively easy to install.

Below, some specific features are indicated, of which one or more may be used in the herein described embodiments:

1. A hollow baseboard (as example of the lighting element) equipped with a linear array of LEDs on a printed circuit board in combination with an extruded optical element, located inside a baseboard. The baseboard has a window that has a transparent cover through which the light can exit and illuminate a floor or a wall.
2. For ease of installation and ease of powering, the baseboards are clicked onto a power rail (an embodiment of the building element).
3. The power rail consists of a number of power-rail modules in series. Each power rail module has at least 1 controller (herein also indicated as building element control unit).
4. Each baseboard is equipped with at least 1 controller (herein also indicated as lighting element control unit).
5. The individual baseboards and groups of LEDs in each baseboard are addressable in order to create dynamic effects along the length of all connected baseboards.
6. For illuminating the wall and the floor, the same LEDs may be used.

Amongst others, with one or more of the above features a method to determine the order of the baseboards, based on the aforementioned controllers, is also provided.

Referring to e.g. FIGS. 1*c*, 2*a*, 2*b*, but also some of the other schematic drawings, the light sources are concealed from normal view (of a viewer).

Figure 2C:
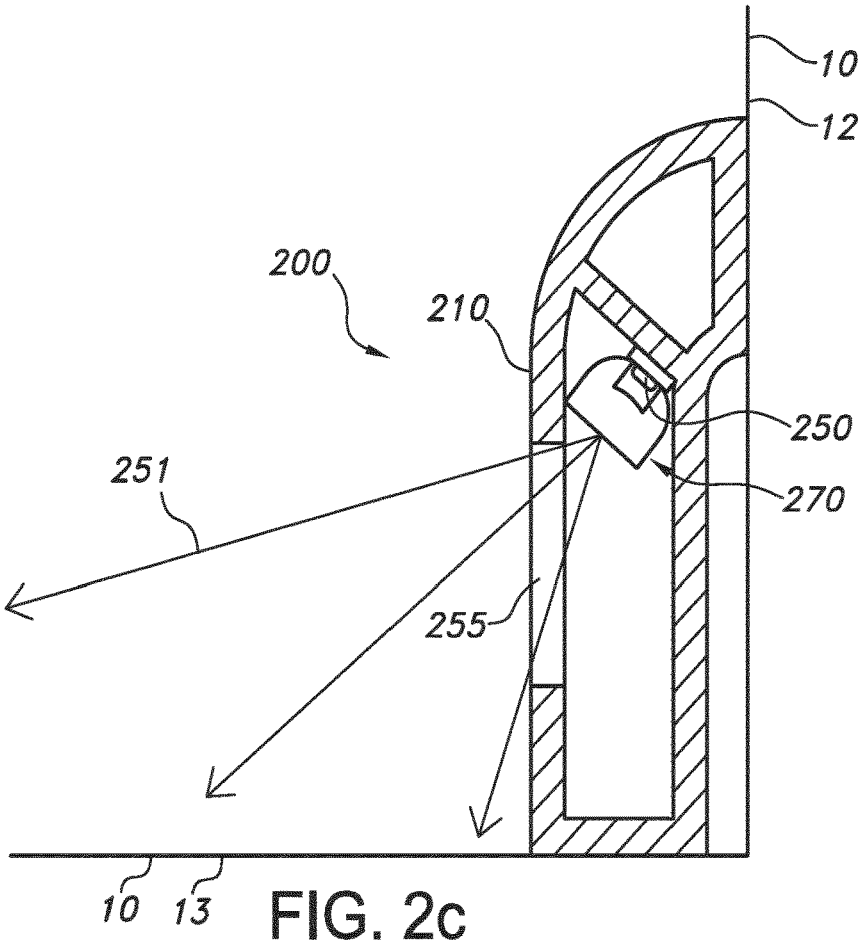

FIG. 2*c* schematically depicts a hollow baseboard located in the corner of a floor and a wall. Inside the baseboard is a LED array on e.g. a PCB with an extruded optical element in front. The optical element has the function of collimating the light emitted by the LEDs. The light emitted by the LEDs shines through a transmissive window 255 onto the floor, the beam having a relatively small beam angle of about 55° in a direction transverse to the elongated lighting element, attained by additional lens optics 270. The window may have an optical function (e.g. redirecting the light or further collimating the light). The light source and window are arranged such that one cannot look directly into the light source while still a considerable part of a floor or wall can be illuminated in a fairly homogeneous manner.

Figure 2D:
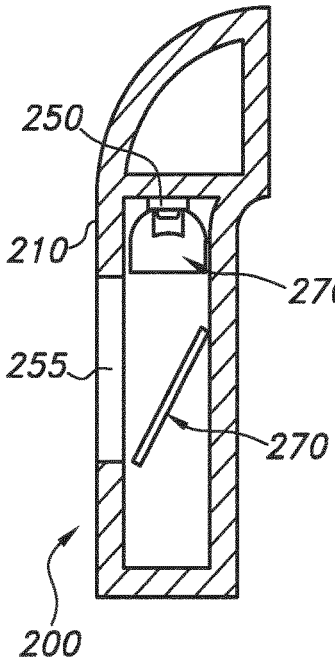
Figure 2E:
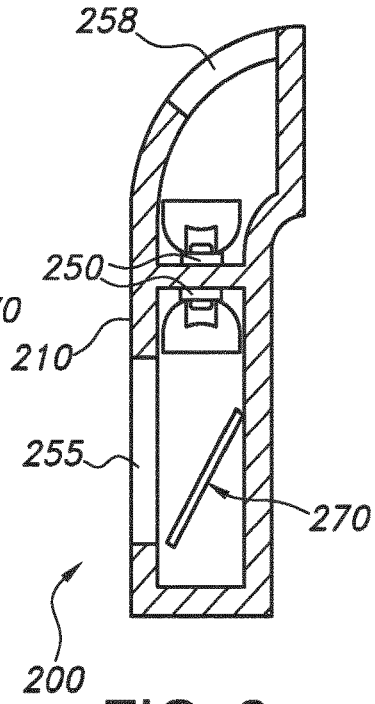
Figure 2F:
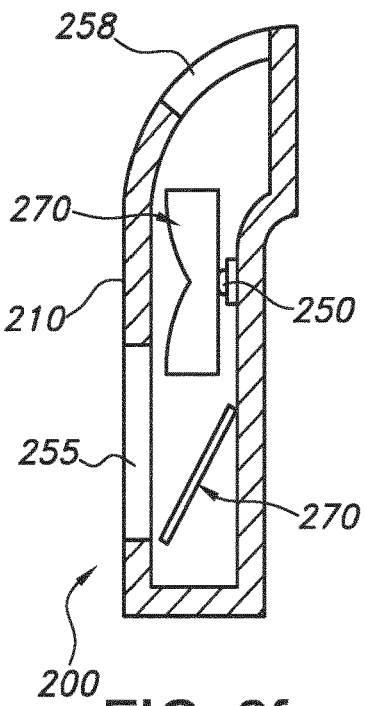

FIGS. 2*d* and 2*e* show similar embodiments. In FIG. 2*d* a mirror as an additional optics is used to re-direct the light emitted by the combination of LEDs and optical element towards the floor. In addition, in FIG. 2*e* a second LED array and optical element are used to also provide a wall washing functionality via a transparent window 255. FIG. 2*f* shows an embodiment in which the light from a single linear array of LEDs is split into a downward directed beam of light as well as an upward directed beam of light. This is done by means of an extruded additional TIR optics that serves the function of beam splitting and collimation. Amongst others, a functional prototype of the first of one of the embodiments discussed above was built. An image of this prototype is shown in 3*a*. Here the electrical power connectors and attachment units are integrated in male-female construction.

Referring to e.g. FIGS. 2*c*-3*a*, the lighting element 200 comprises a (hollow) body, with the elongated) front side, and the light source(s) and optionally other elements integrated in the body. Optionally, the front side may include a light transmissive part (see amongst others also above). The light transmissive part includes a light transmissive material, like (translucent) glass or polymer.

Figure 3A:
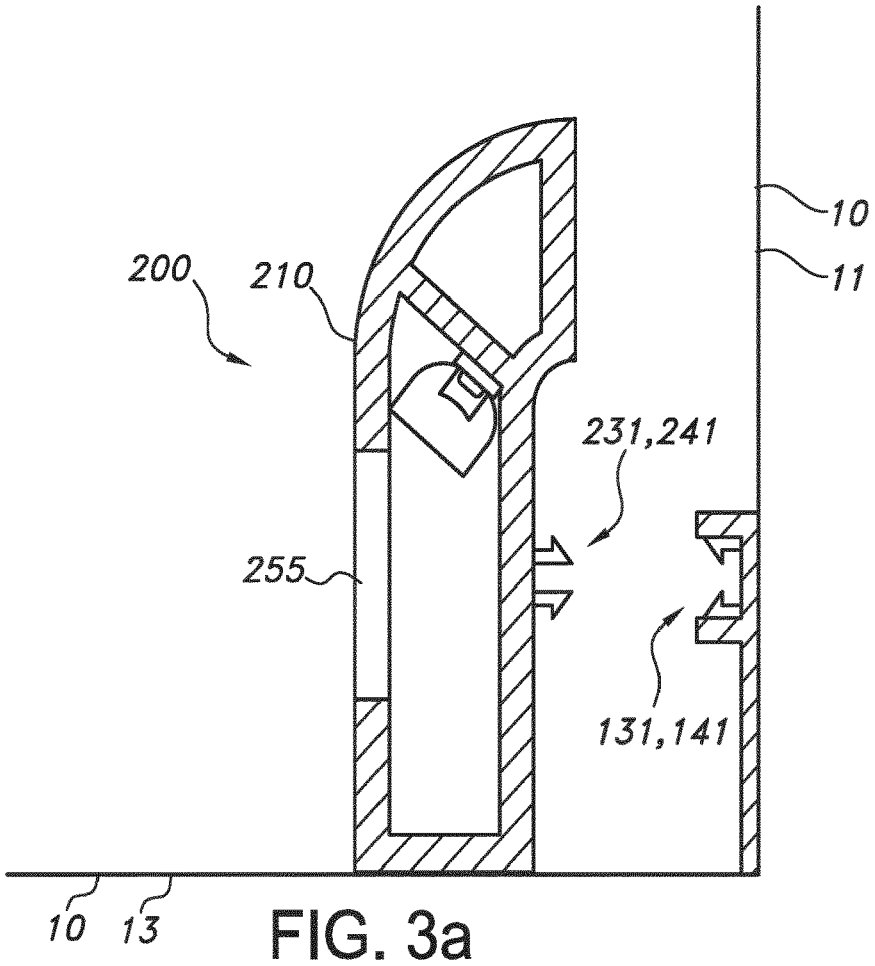
FIGS. 3*a*-3*d* schematically depict some further aspects of the invention.

FIG. 3*a* shows an example of a baseboard 200 with ease of installation and ease of powering. The baseboard is to be clicked onto a building part 10, i.e. wall 11. The building part comprises a female first attachment unit 131 in one piece with, or integral with a first electrical power connector 141 with. The baseboard comprises a male second attachment unit 231 integral with, or in one piece with a second electrical power connector 241. Hence, with one simple click the baseboard is both mechanically and electrically connected.

Figure 3B:
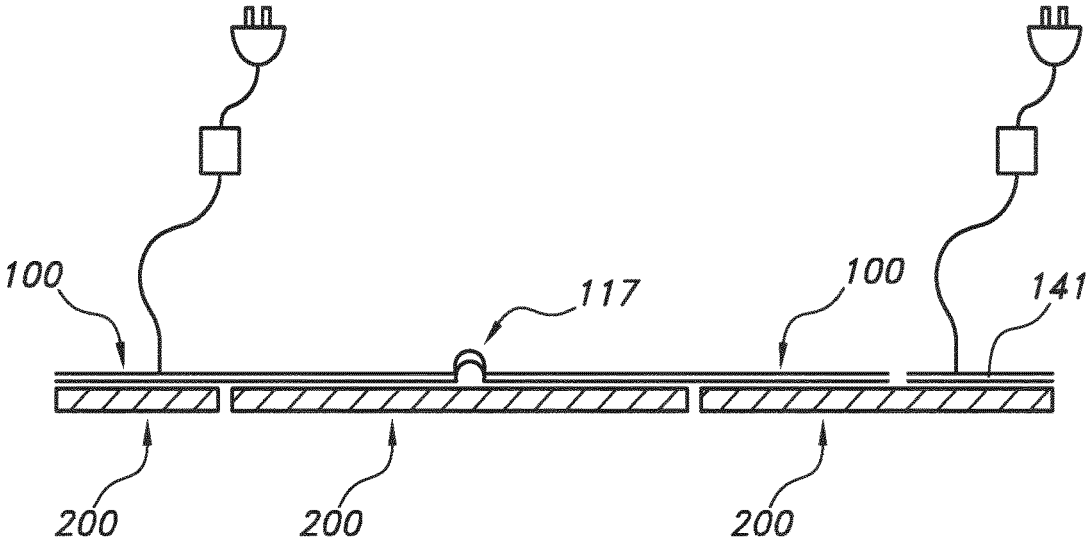

A further embodiment will be discussed next with reference to 3*b*. FIG. 3*b* shows is a method of powering the baseboard. In this method, from a powering point of view, the baseboard system is divided into two basic elements. One element is a DC power rail that is mounted on the wall or integrated in a building element. At a central location, the power rail is connected to the mains. The power rail can be cut to the required length and, with connecting elements, guided around corners. An AC-DC convertor converts AC mains voltage to DC voltage. It can be located near a mains outlet or be integrated in (a part of) the power rail. The baseboard or other type of lighting element 200 can be clicked onto the power rail via a power receptacle or electrical power connections. Preferably, the DC voltage provided by the power rail is a low-voltage (preferably below 50V).

For reasons of safety and reasons of practicality, the AC-DC convertor can provide a limited current only. This implies that each AC-DC convertor can deliver the required current only for a limited length of the power rail. Once this length is exceeded, a next convertor is used. See also FIG. 3*b*. As shown in the figure, a power rail can consist of a number of power rail modules (disconnected or connected in series). A baseboard can overlap more than one power rail module (in the figure, the baseboard overlaps power rails). Electronics for dimming can be located inside the baseboard or close to the AC-DC convertor. The same holds for wireless communication modules.

Figure 3C:
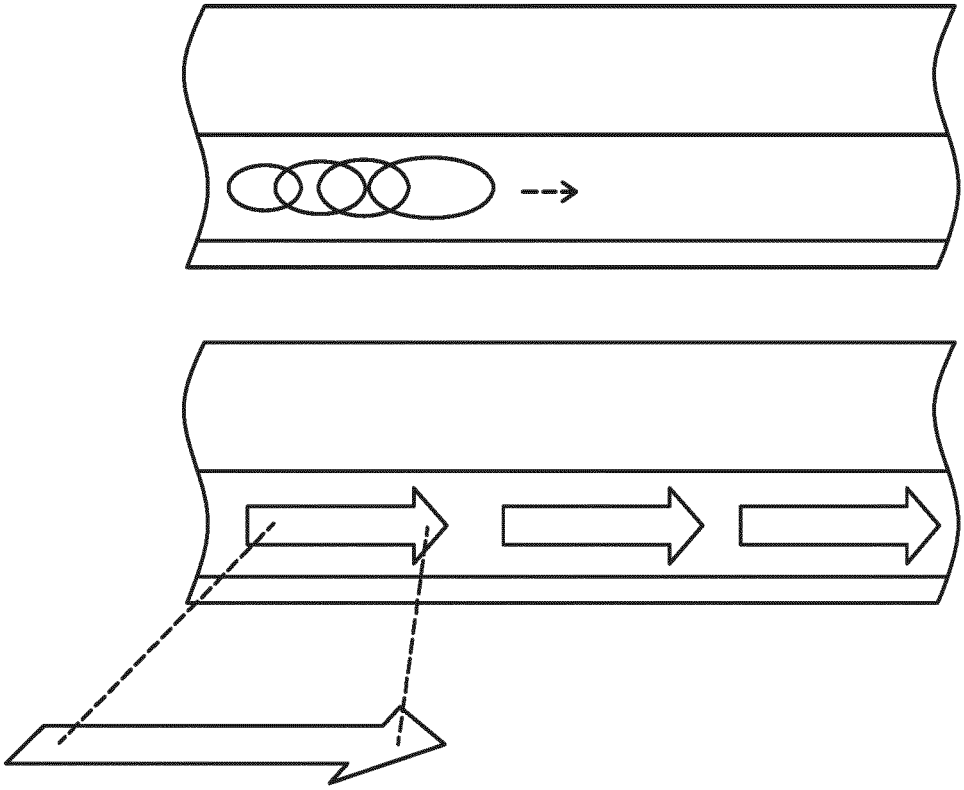
Figure 3D:
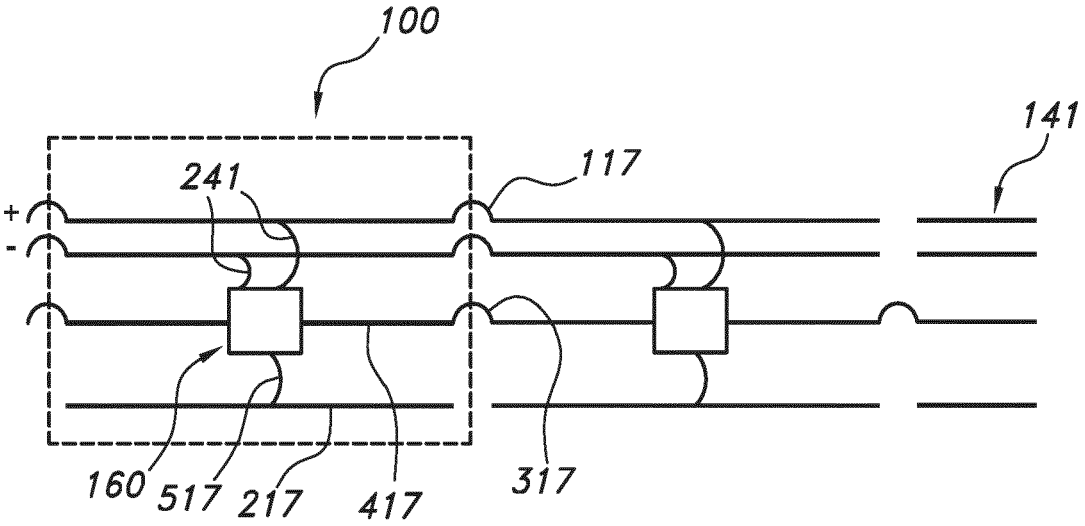

A further embodiment is schematically shown in FIG. 3*c*. In this embodiment the LEDs or groups of LEDs are individually addressable. This allows one to provide dynamic light effects. For example, color gradients across the length of the baseboard. Also, the lighting effects can be changed from an ambient lighting mode to an emergency lighting mode. In the emergency lighting mode, a moving pattern of light (cf. FIG. 3*c* top) can be offered to guide people away from a hazard (e.g. fire or smoke). In addition, patterns such as arrows ((cf. 3*c* bottom) can be shown or projected to guide people away from a hazard.

For this to function in practice, a problem has to be solved. To illustrate the problem, as an example, assume we want to implement a feature as shown in FIG. 3*c* bottom: an arrow that moves from the beginning of a corridor in an office building to the end of the corridor. Upon reaching the end of a baseboard, the arrow has to continue on the next baseboard. For this to happen, it is required that we can individually address each baseboard and that we know the order of the baseboards. This poses a problem since we do not know this order in advance (and we wish to avoid a complicated manual commissioning process). Herein, it is proposed to solve this problem, in a generic way. We propose a power rail layout as sketched in FIG. 3*d*. In this figure, it is shown that apart from two wires providing power (ref 141), there are controllers 160 (for instance for each building element 100) and additional wires: a serial data line (Ref 417) and a baseboard communication line (Ref 217). Refs. 117 and 317 indicate respective connectors; the former may be used to electrically connect the building elements (for DC mains); the latte may be used to connect the respective baseboard or building element communication lines 217. Elements 517 indicate connections to provide instructions to each respective lighting element (not shown in detail; but indicated as line). Note that optionally the base board communication lines may also be connected, instead of or in addition to connectors 317.

The complete power rail consists of a number of power rail modules connected in series. Each power rail module has a controller. The controllers of different power rail modules are connected in series. The beginning of the serial line C is connected to a master controller. Optionally, an AC-DC convertor may be co-located with a (master) controller. The master controller and/or AC-DC converter may be embedded in a first building element, or may be arranged outside from the building elements. This master controller sends a signal along the serial line (Ref. 417). Suppose the signal offered by the master controller to the receiving end of the serial data line (Ref. 417) is the number 1 (in binary code). The first controller intercepts this signal and reads it as being number 1. On its turn, it increases this number by 1, thereby sending the number 2 further along the serial line. The next controller will intercept the number 2 and will send the number 3 along the line, etc. In this manner each controller will know its relative location with respect to the other controllers.

Each baseboard will be attached to the power rail and connected to wires A and B for power and wire 217 for communication (note that for wire 217 there is no connecting bridge between neighboring power rail modules). Wire 217 is a line for communication with the baseboard: via this wire, the baseboard attached to this wire gets instructions.

Suppose, as an example, that each baseboard has 10 individually addressable groups of LEDs (each group representing an arrow as shown in FIG. 3*c*). With the system described above, implementing a moving arrow is now straightforward. Assume for the sake of the argument that every power rail module is attached to exactly one baseboard. Via the serial line, the master-controller can now simply send commands like "switch on LED group n of baseboard m". The controllers in the power rail can identify baseboard m, while a controller in the baseboard can identify LED group n. In case there can be more than one baseboard connected to a power rail module, the power rail modules have to be equipped with at least as many controllers as the maximum number of baseboards that might be connected to a single power rail module.

The power rail controllers can interrogate the baseboards they are connected to and vice versa. When there is no connection, this can be communicated to the master controller. Note that the power rail can also be integrated into the baseboards altogether. In that case the ends of the baseboards have to be connected together via a coupling element 317 that bridges the line 417 and, optionally, lines 141 (with connector(s) 117).

When installing baseboards, some need to be cut to fit. This is especially the case near corners. In our case, the baseboards are equipped with a linear LED array. Typically, the LEDs are grouped. In each group, LEDs are put in series. Each group represents a certain length along the baseboard. It is allowed to cut the baseboard in between groups. We propose to add markers (at the back of the baseboard) to indicate locations were the baseboard can be cut. Note that, after cutting, the baseboard will in general be too short to exactly fit the space near corners. The remaining space can be occupied with a dummy baseboard that has no lighting functionality. Note that it is also possible to have cut-to-measure electronics for LEDs on a PCB. In this case, the PCB can be cut to any length. This implies that in this case also the baseboard can be cut to any length.

Referring to the embodiments described above and schematically depicted, an impressive lighting effect may be created within a space, with minimally visible elements. Further, by integrating in e.g. a baseboard or ceiling board, etc., such lighting element may be substantially unobtrusively installed.

The invention claimed is:

1. An elongated lighting element for attachment to a building part selected from the group consisting of a wall, a ceiling and a floor, wherein the building part comprises a first attachment unit and a first electrical power connector, wherein the elongated lighting element has an elongated front side and at the other side of the front side (i) a second attachment unit for forming with the first attachment unit said attachment to said building part, (ii) a second electrical power connector for forming an electrical connection with the first electrical power connector, and (iii) a plurality of light emitting diode light sources, mounted on at least one circuit board and configured to provide light source light and functionally connected with the second electrical power connector, wherein the element comprises a virtual element plane, which, when the element is attached to the building part, will be configured parallel to the building part, wherein the plurality of light emitting diode light sources further comprise additional optics, said additional optics rendering the lighting element to be configured to provide at least 50% of said light source light within a space defined by said virtual element plane parallel to the elongated front side and a second virtual plane in which edge of lighting element lies and which is perpendicular to said virtual element plane, wherein the solid state based light sources are arranged next to each other in a row along an edge of the elongated lighting element and in a length direction of the elongated lighting element, and wherein the additional optics is an extruded collimator that ensures that a beam angle of the light emitted by each light source element is greater in said length direction than a beam angle transverse to said length direction.

2. The lighting element according to claim 1, wherein the lighting element is an element selected from the group consisting of a baseboard, a base molding and a ceiling molding.

3. The lighting element according to claim 1, wherein the lighting element further comprises a lighting element control unit configured to control the light emitting diode light sources in dependence of an external signal.

4. The lighting element according to claim 3, wherein the lighting element comprises a plurality of subsets of light emitting diode light sources, wherein the lighting element control unit is configured to control the plurality of subsets of light emitting diode light sources independently.

5. The lighting element according to claim 3, wherein the lighting element control unit is configured to provide information about the light emitting diode light sources to an external control unit.

6. The lighting element according to claim 1, wherein the front side comprises two separate transmissive windows, and wherein one or more light emitting diode light sources are configured to provide said light source light downstream from each of said transmissive windows.

7. A kit of parts comprising (i) the elongated lighting element according to claim 1 and (ii) a building element, wherein the building element comprises a first attachment unit and a first electrical power connector for a functional attachment and electrical connection of the building element and the elongated lighting element.

8. The kit of parts according to claim 7, wherein the building element comprises a building element control unit, and wherein the lighting element further comprises a lighting element control unit configured to control the light emitting diode light sources in dependence of signal from the building element control unit.

9. The kit of parts according to claim 7, wherein one or more of lighting element control unit and the building element control unit are configured to communicate with one or more of a lighting element control unit and a building element control unit of another lighting element and building element, respectively.

10. A lighting system comprising a plurality of elongated lighting elements as defined in claim 1, wherein the elongated lighting elements and the one or more building elements are functionally coupled.

11. The lighting system according to claim 10, wherein neighboring lighting elements are functionally connected to each other, and wherein the lighting system further comprises a communication line configured to provide instructions to each lighting element.

12. A method to provide information to a user, the method comprising using the lighting system according to claim 10, wherein the light source light is used to provide said information.

13. The method according to claim 12, wherein the lighting system provides a moving pattern of light to guide a user in a specific direction.

14. The lighting element according to claim 1, wherein at least one of said circuit boards is tilted at an obtuse angle relative to the virtual element plane.

15. The lighting element according to claim 1, wherein said additional optics comprises a mirror.

16. The lighting element according to claim 1, wherein said additional optics comprises TIR (Total Internal Reflection) optics that serve the function of beam splitting.

17. The lighting element according to claim 1, wherein said plurality of light emitting diode light sources, mounted on at least one circuit board is further configured to emit light source light substantially in one direction.

18. The Lighting element according to claim 17, wherein the building part is a room wall and the light source light is provided to both the wall and a room surface perpendicular to the wall.

19. The lighting element according to claim 1, wherein the additional optics is a lens.

* * * * *